US009215938B2

(12) United States Patent
Neumann et al.

(10) Patent No.: US 9,215,938 B2
(45) Date of Patent: Dec. 22, 2015

(54) PRODUCT DISPLAY SYSTEM WITH ADJUSTABLE BRACKET

(71) Applicant: Display Technologies, Inc., Lake Success, NY (US)

(72) Inventors: Eric Neumann, Mamaroneck North Hills, NY (US); Eleanor Lovinsky, Brooklyn, NY (US); David Piazza, Bronx, NY (US); Anthony Camello, Staten Island, NY (US)

(73) Assignee: Display Technologies, LLC, Lake Success, NY (US)

( * ) Notice: Subject to any disclaimer, the term of this patent is extended or adjusted under 35 U.S.C. 154(b) by 0 days.

(21) Appl. No.: 14/297,683

(22) Filed: Jun. 6, 2014

(65) Prior Publication Data

US 2014/0319088 A1 Oct. 30, 2014

Related U.S. Application Data

(62) Division of application No. 13/021,276, filed on Feb. 4, 2011, now abandoned.

(60) Provisional application No. 61/301,796, filed on Feb. 5, 2010.

(51) Int. Cl.
*A47F 1/12* (2006.01)
*A47F 5/08* (2006.01)

(52) U.S. Cl.
CPC ..... *A47F 1/126* (2013.01); *A47F 1/128* (2013.01); *A47F 5/0838* (2013.01)

(58) Field of Classification Search
CPC .... A47B 73/00; A47B 73/002; A47B 73/006; A47B 73/008; A47B 57/42; A47B 96/061; A47F 1/126; A47F 1/12; A47F 1/125; A47F 1/128; A47F 1/121; A47F 5/13; A47F 5/01; A47F 5/0846; A47F 5/0869; A47F 5/0838; A47F 7/285
USPC ..... 211/74, 75, 7, 51, 57.1, 59.1, 59.3, 211/59.2; 248/200, 214, 215, 200.1, 227.4, 248/220.22
See application file for complete search history.

(56) References Cited

U.S. PATENT DOCUMENTS

| | | | | |
|---|---|---|---|---|
| 2,100,935 | A | 11/1937 | Black | |
| 2,460,997 | A | 2/1949 | Myers | |
| 2,566,405 | A | 9/1951 | De Lange et al. | |
| 2,623,641 | A | 12/1952 | Shield | |
| 2,900,085 | A | 8/1959 | Levy | |
| 3,027,015 | A | 3/1962 | Miller | |
| 3,175,243 | A | 3/1965 | Weber | |
| 3,679,067 | A * | 7/1972 | Konstant | 211/182 |

(Continued)

*Primary Examiner* — Patrick Hawn
(74) *Attorney, Agent, or Firm* — Carter, DeLuca, Farrell & Schmidt, LLP

(57) ABSTRACT

A product display system includes a plurality of brackets, a plurality of shelves, and a plurality of products. Each bracket is configured to mechanically engage a support structure. Each shelf is mechanically engaged with at least one bracket. The shelves form a first row, a second row, a third row, a first column, a second column, and a third column. The first row is adjacent the second row, and the second row is adjacent the third row. The first column is adjacent the second column, and the second column is adjacent the third column. Each product is supported by one of the shelves. The shelves are arranged such that the distance between the shelves in the first column and the third column is smaller than the width of the product supported by the shelves in the second column.

10 Claims, 10 Drawing Sheets

(56) References Cited

U.S. PATENT DOCUMENTS

| | | | | | |
|---|---|---|---|---|---|
| 3,853,222 | A | | 12/1974 | Helms | |
| 3,966,158 | A | * | 6/1976 | Boundy | 248/243 |
| 4,042,096 | A | | 8/1977 | Smith | |
| 4,150,753 | A | | 4/1979 | Stahl et al. | |
| 4,184,726 | A | | 1/1980 | Cox | |
| 4,215,784 | A | | 8/1980 | Perkins | |
| 4,316,546 | A | | 2/1982 | Varon et al. | |
| 4,316,547 | A | * | 2/1982 | Varon | 211/105.1 |
| 4,344,540 | A | | 8/1982 | Marschak | |
| 4,422,555 | A | | 12/1983 | Jacobs | |
| 4,455,007 | A | * | 6/1984 | Varon et al. | 248/251 |
| 4,804,270 | A | | 2/1989 | Miller et al. | |
| 4,882,868 | A | | 11/1989 | Fast | |
| 5,038,978 | A | | 8/1991 | Kolton et al. | |
| 5,067,620 | A | | 11/1991 | Norrie | |
| 5,133,463 | A | * | 7/1992 | Merl | 211/190 |
| 5,305,898 | A | * | 4/1994 | Merl | 211/87.01 |
| 5,509,541 | A | | 4/1996 | Merl | |
| 5,526,941 | A | | 6/1996 | Ford | |
| 5,547,156 | A | | 8/1996 | Djuric | |
| 5,578,862 | A | | 11/1996 | Fujii et al. | |
| 5,711,432 | A | | 1/1998 | Stein et al. | |
| 5,855,283 | A | | 1/1999 | Johnson | |
| 5,857,577 | A | | 1/1999 | Thomas et al. | |
| 5,862,925 | A | | 1/1999 | Grzywinski | |
| 5,865,326 | A | | 2/1999 | Spamer et al. | |
| 5,906,704 | A | | 5/1999 | Matsuura et al. | |
| 5,947,303 | A | | 9/1999 | Robolin | |
| 5,983,432 | A | | 11/1999 | Jones | |
| 6,004,597 | A | | 12/1999 | Coleman et al. | |
| 6,161,708 | A | | 12/2000 | Myler | |
| 6,168,032 | B1 | * | 1/2001 | Merl | 211/59.2 |
| 6,360,903 | B1 | | 3/2002 | Flores | |
| 6,382,430 | B1 | | 5/2002 | Dewsnap | |
| 7,128,223 | B1 | * | 10/2006 | Sarnoff et al. | 211/90.03 |
| 7,438,268 | B2 | | 10/2008 | Kologe | |
| 7,681,744 | B2 | | 3/2010 | Johnson | |
| 7,954,656 | B1 | * | 6/2011 | Cuzzocrea | 211/189 |
| 8,210,367 | B2 | | 7/2012 | Nagel et al. | |
| 8,240,486 | B2 | | 8/2012 | Niederhuefner et al. | |
| 2003/0178539 | A1 | | 9/2003 | Simonian et al. | |
| 2004/0118793 | A1 | | 6/2004 | Burke | |
| 2005/0199563 | A1 | | 9/2005 | Richter et al. | |
| 2006/0180561 | A1 | | 8/2006 | Wisnoski et al. | |
| 2007/0158284 | A1 | | 7/2007 | Felder | |
| 2008/0110843 | A1 | | 5/2008 | Hafif | |
| 2008/0237420 | A1 | | 10/2008 | Wayman et al. | |

* cited by examiner

PRODUCT DISPLAY SYSTEM WITH ADJUSTABLE BRACKET

CROSS-REFERENCE TO RELATED APPLICATION

The present application is a divisional application of U.S. application Ser. No. 13/021,276, filed Feb. 4, 2011, which claims the benefit of and priority to U.S. Provisional Application No. 61/301,796, filed Feb. 5, 2010, the entire contents of each of which are incorporated herein by reference.

BACKGROUND

The present disclosure relates generally to a system for displaying products on shelves. More particularly, the present disclosure relates to a system for optimizing the number of products displayable on a plurality of shelves and to an adjustable bracket for use therewith.

Various types of product displays are commonly used in retail environments to display different types of products. As opposed to simply positioning products on shelves, product displays are commonly used to position products on a shelf in manner which automatically advances (e.g., via gravity or a pusher) a trailing or distal product (i.e., a product that is behind a lead or proximal-most product) closer to a user once the lead product has been removed from the shelf. As can be appreciated, such product displays facilitate the arrangement and upkeep of products, as the trailing products don't have to be manually moved towards the front of the shelf, for instance.

Additionally, it is often desirable to maximize the amount of products (e.g., containers of salad dressing) a retailer can display in a given area. More specifically, retailers generally want as many products to fit side-by-side (or horizontally) and top-to-bottom (vertically) on shelves as possible to take full advantage of all of the allotted space, and to allow the consumer to view as many products (e.g., brands, flavors) as possible.

SUMMARY

The present disclosure related to a product display system comprising a plurality of brackets, a plurality of shelves, and a plurality of products. Each bracket is configured to mechanically engage a support structure. Each shelf is mechanically engaged with at least one bracket. The shelves form a first row, a second row, a third row, a first column, a second column, and a third column. The first row is adjacent the second row, and the second row is adjacent the third row. The first column is adjacent the second column, and the second column is adjacent the third column. Each product is supported by one of the shelves. The shelves are arranged such that the distance between the shelves in the first column and the third column is smaller than the width of the product supported by the shelves in the second column.

The present disclosure also relates to an adjustable bracket for engaging a support structure and for supporting a portion of a shelf. The adjustable bracket comprising a first support member and a second support member. The second support structure is releasably securable to the first support structure in at least two different locations.

BRIEF DESCRIPTION OF DRAWINGS

Embodiments of the present disclosure are described hereinbelow with reference to the drawings wherein.

DESCRIPTION

Embodiments of the presently disclosed product display system are described in detail with reference to the drawings wherein like numerals designate identical or corresponding elements in each of the several views. As is common in the art, the term "proximal" refers to that part or component closer to the user, e.g., customer, while the term "distal" refers to that part or component farther away from the user.

In combination with the accompanying FIGS. 1-11, a product display system 100 of the present disclosure is described herein. The product display system 100 of the present disclosure includes a plurality of shelves 200 orientated in a staggered fashion, and a plurality of adjustable brackets 300*a*, 300*b* for supporting the shelves 200 (and/or for supporting horizontal bars 400 that support the shelves 200).

Figure 1:
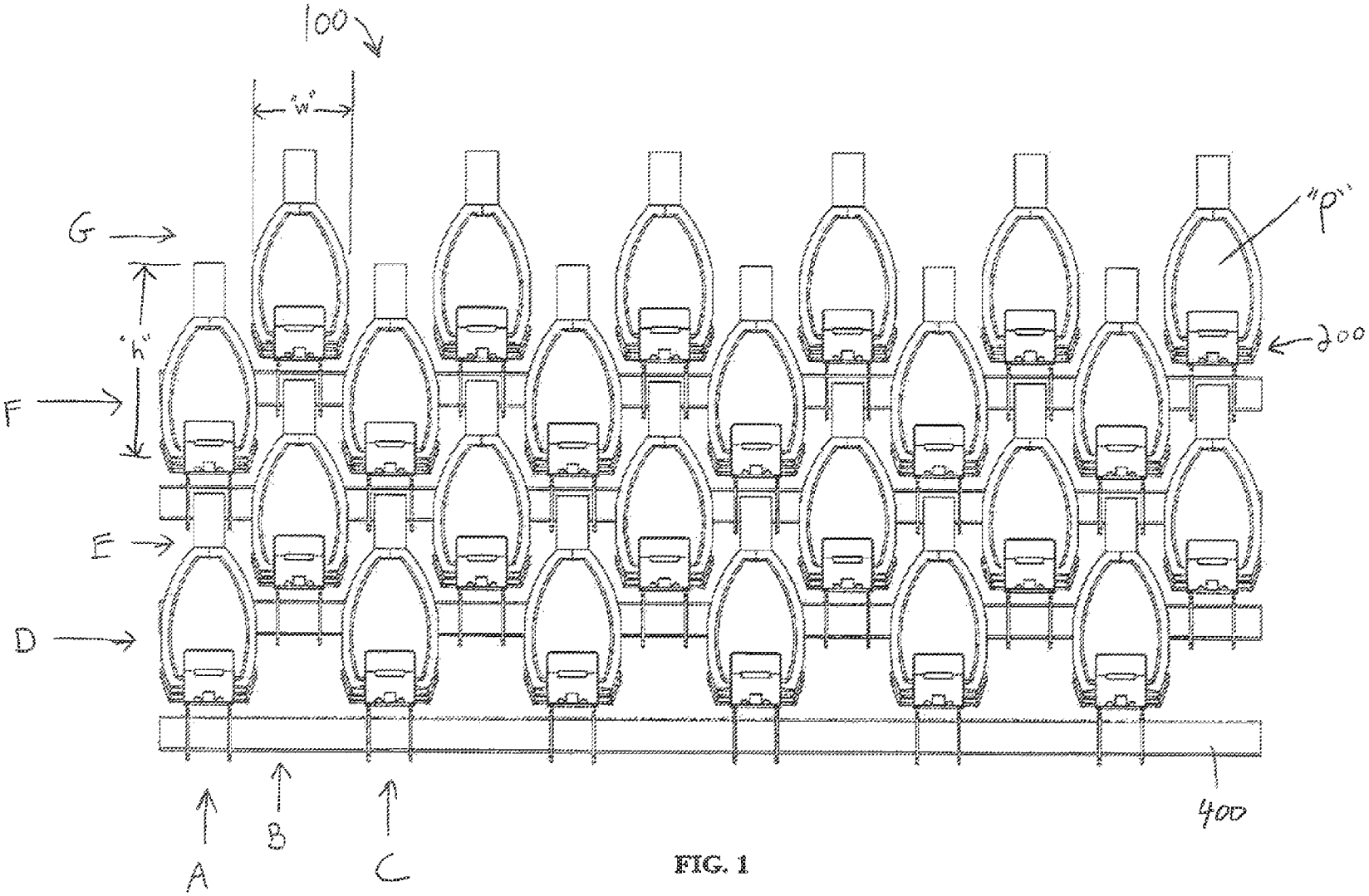
FIG. 1 illustrates a front view of a product display system including a plurality of shelves according to an embodiment of the present disclosure, and including containers of salad dressing displayed on the shelves.
Figure 2:
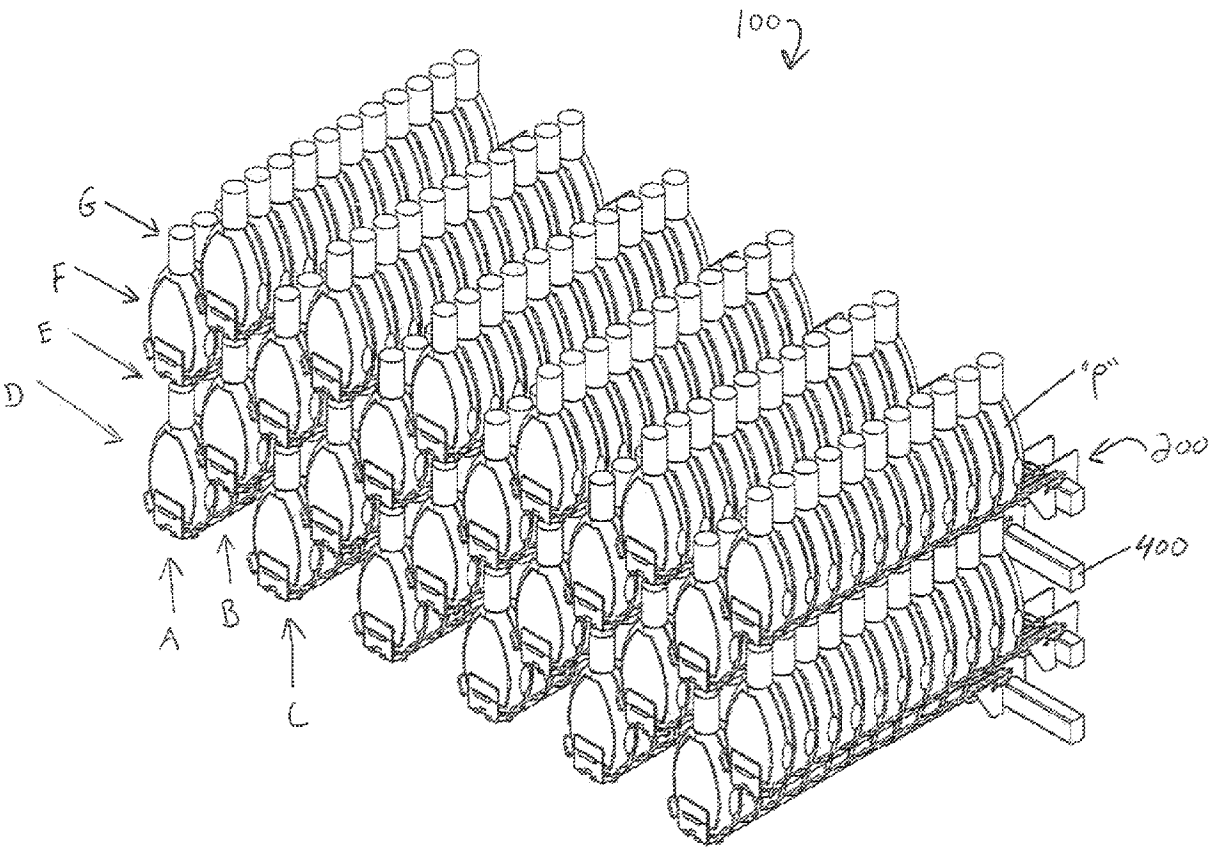
FIG. 2 is a perspective view of the product display system of FIG. 1.

As shown in FIGS. 1 and 2, the shelves 200 are staggered in both the vertical and horizontal directions. More particularly, the horizontal space between the closest portions of shelves 200 in Column "A" and the shelves 200 in Column "C," is smaller than the width "w" of the products in Column "B." Additionally, the vertical space between the shelves in Row "D" and Row "E," is smaller than the height "h" of the products in Rows "D," "E," "F," and "G."

In such a configuration, the orientation of the shelves 200 takes advantage of the otherwise-unused spaced between adjacent products "P." More particularly, given the specific design of certain containers (e.g., salad dressing containers, such as those having similar shapes to those illustrated in FIGS. 1 and 2), there is typically unused or "negative" space between neck portions of adjacent containers. Additionally, when a plurality of such products "P" are displayed on a single shelf 200, the amount of unused space is multiplied by the amount of products on each shelf. Therefore, as can be appreciated, the product display system 100 of the present disclosure allows more products to be displayed/stored in the same amount of space than traditional product displays with non-staggered shelves.

With reference to FIGS. 3-7, adjustable brackets 300*a*, 300*b* of the disclosed product display system 100 are illustrated. With specific reference to FIGS. 3-6, the adjustable brackets 300*a*, 300*b* include a body or plate 320 and a brace or C-channel 340. As shown, the C-channel 340 is non-centered vertically with respect to the plate 320, thus resulting in a different amount of space between the top 342 of the C-channel 340 and the top 322 of the plate 320, as compared to the bottom 344 of the C-channel 340 and the bottom 324 of the plate 320. The adjustable brackets 300*a*, 300*b* are configured to support at least one end of a horizontal bar 400 (shown in FIGS. 1 and 2) that supports a row of shelves 200.

In the illustrated embodiments, C-channel 340 includes a pair of bores 350*a*, 350*b* extending therethrough on opposing sides thereof. Additionally, it is envisioned that the horizontal bar 400 includes a hole that extends therethrough. Here, a pin can be placed through the bore 350*a*, through the hole in the horizontal bar 400 and/or through the bore 350*b* to help keep the horizontal bar 400 engaged with the C-channel 340.

Figure 3:
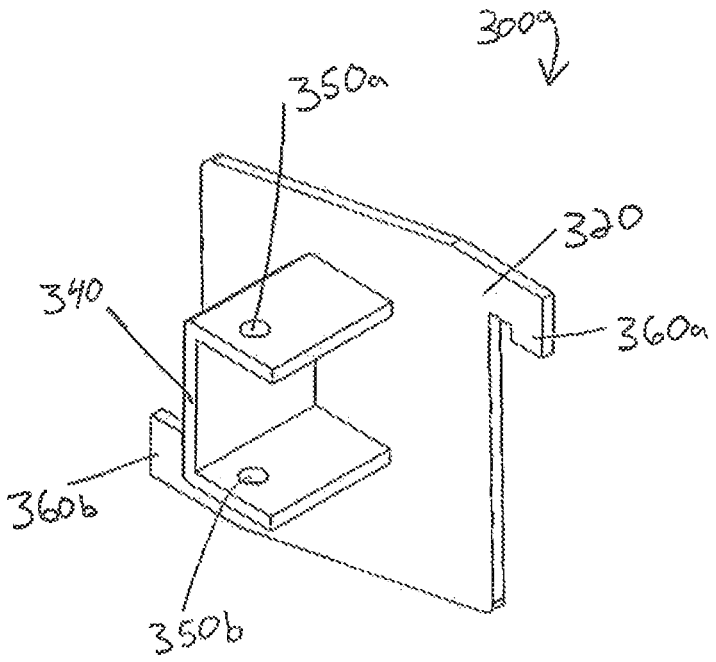
FIGS. 3-7 are various views of an adjustable bracket which may be used as a part of the product display system of FIGS. 1 and 2.
Figure 4:
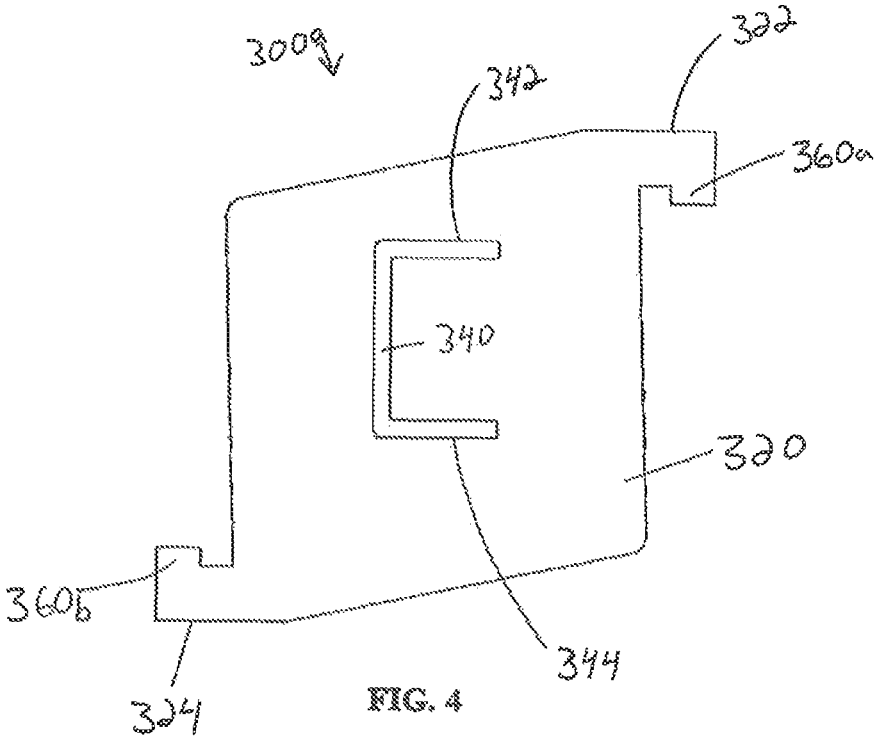
Figure 5:
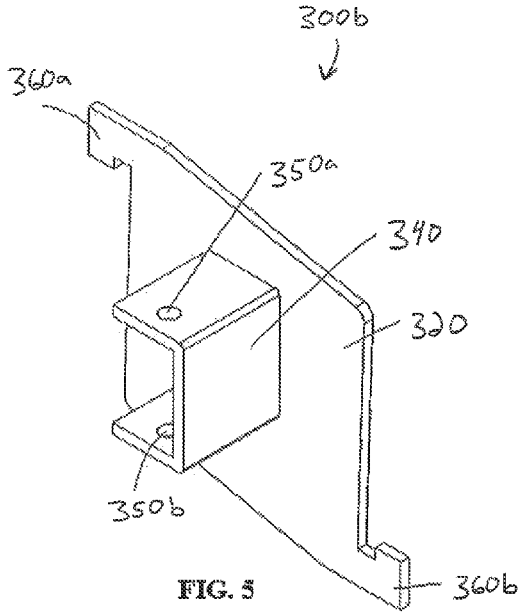
Figure 6:
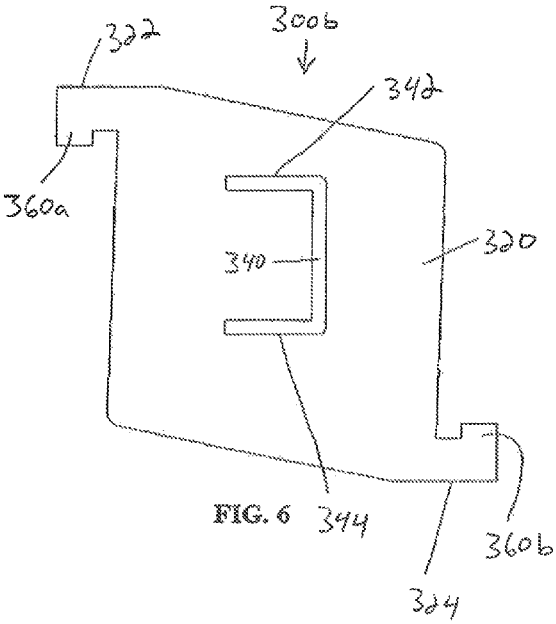
Figure 7:
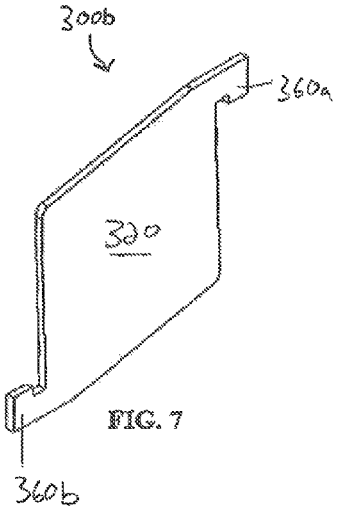

Additionally, the adjustable brackets 300*a*, 300*b* include a pair of nubs 360*a*, 360*b*, with each nub 360 (one nub per configuration of the adjustable brackets 300*a*, 300*b*) being configured to engage an aperture (or similar portion) of a supporting structure (e.g., a peg board or rack, not shown). FIGS. 3 and 4 illustrate a left-side adjustable bracket 300*a*, and FIGS. 5-7 illustrate a right-side adjustable bracket 300*b*. As shown, left-side adjustable bracket 300*a* and right-side adjustable bracket 300*b* are mirror images of each other, and each is configured to support a respective side of the horizontal bar 400. It is also envisioned that the left-side adjustable bracket 300*a* can support the right side of the horizontal bar 400, and vice versa.

Figure 8:
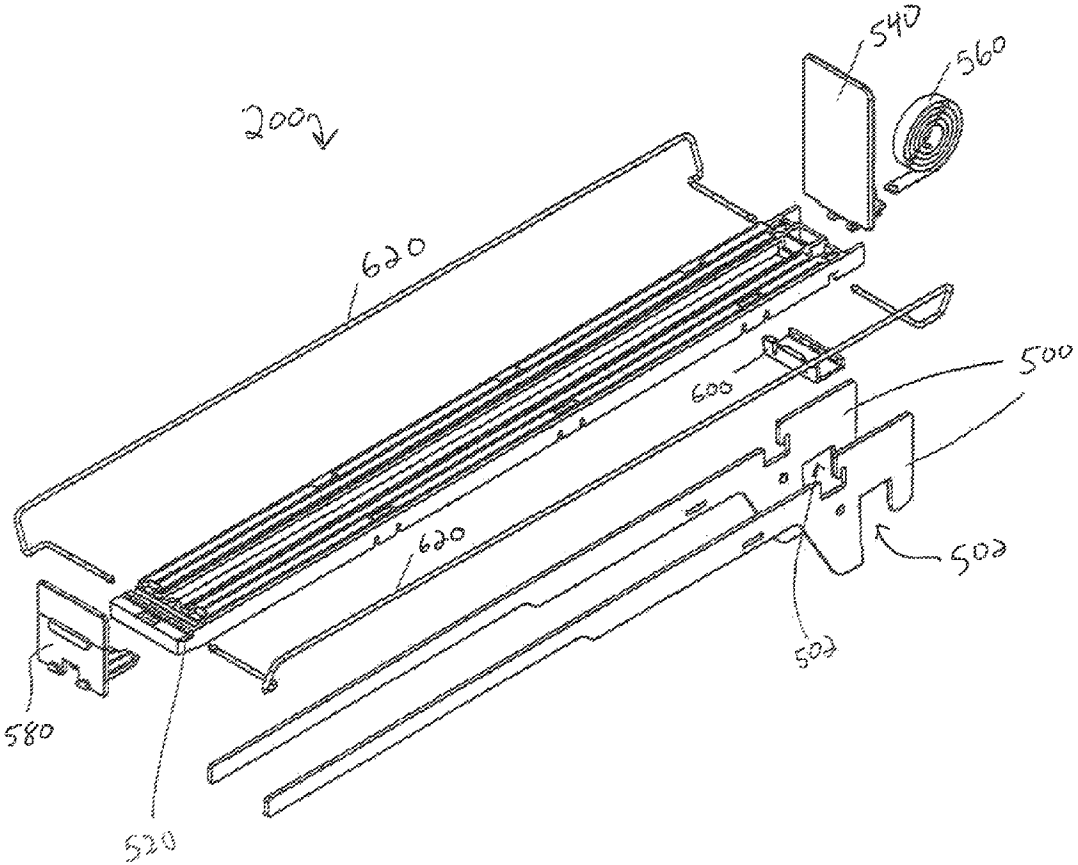
FIG. 8 is an exploded perspective view of various components of the product display system of FIGS. 1 and 2 in accordance with an embodiment of the present disclosure.
Figure 9:
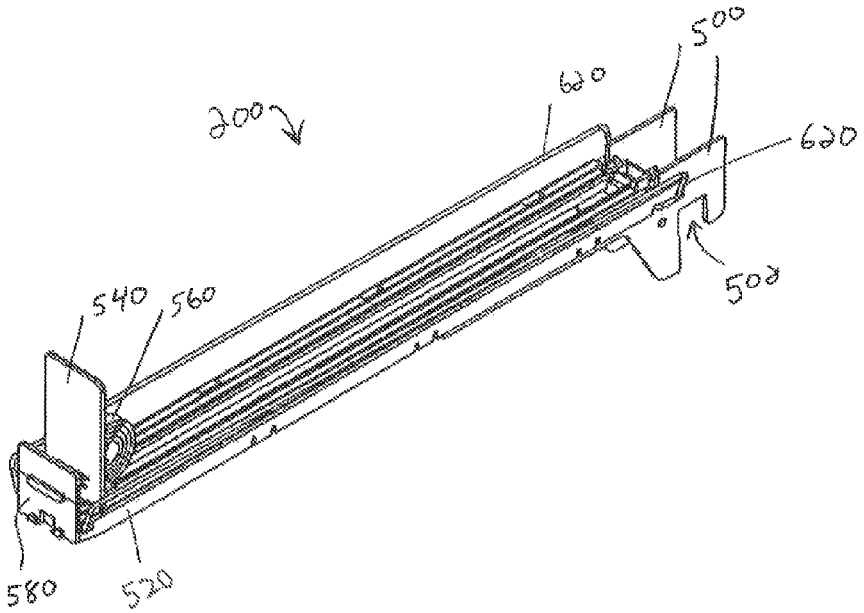
FIG. 9 is an assembled view of the various components of the product display system of FIG. 8.

With reference to FIGS. 8 and 9, a shelf 200 of the present disclosure is shown. As shown, the shelf 200 includes elongated brackets 500. Portions 502 of the elongated brackets 500 are configured to mechanically engage portions of a horizontal bar 400 (see FIGS. 1 and 2). In a disclosed embodiment, the elongated brackets 500 further increase the versatility of the positioning of the shelves 200, as the elongated brackets 500 may be configured slidingly engage the horizontal bars 400. For example, and as can be appreciated with reference to FIG. 8, the structure of the elongated brackets 500, e.g., the portions 502 configured to mechanically engage a horizontal bar 400, allow the shelf 200 to be horizontally translatable (e.g., slidable) with respect to the horizontal bar 400. Therefore, each shelf 200 can be horizontally positioned at a desired location to optimize the display/storage capacity of the product display system 100.

Additional elements of the disclosed shelf 200 are also shown in FIGS. 8 and 9. These features include a track 520 for supporting products thereon, a pusher 540 (shown in a retracted position in FIG. 8 and shown in an advanced position in FIG. 9), a spring 560 for biasing and pushing products "P" proximally towards the customer, a stopper 580 for preventing products from proximally falling off of the shelf 200 and/or for displaying product information (it is envisioned that at least a portion of the stopper 580 is translucent and/or transparent to facilitate viewing the actual product), a back retainer 600 (FIG. 8) configured to mechanically engage a portion of the elongated brackets 500, and a wire 620, a pair of which being configured to mechanically engage the track 500 as sidewalls (e.g., adjustable sidewalls) for helping to contain the products on the track 500.

Figure 10:
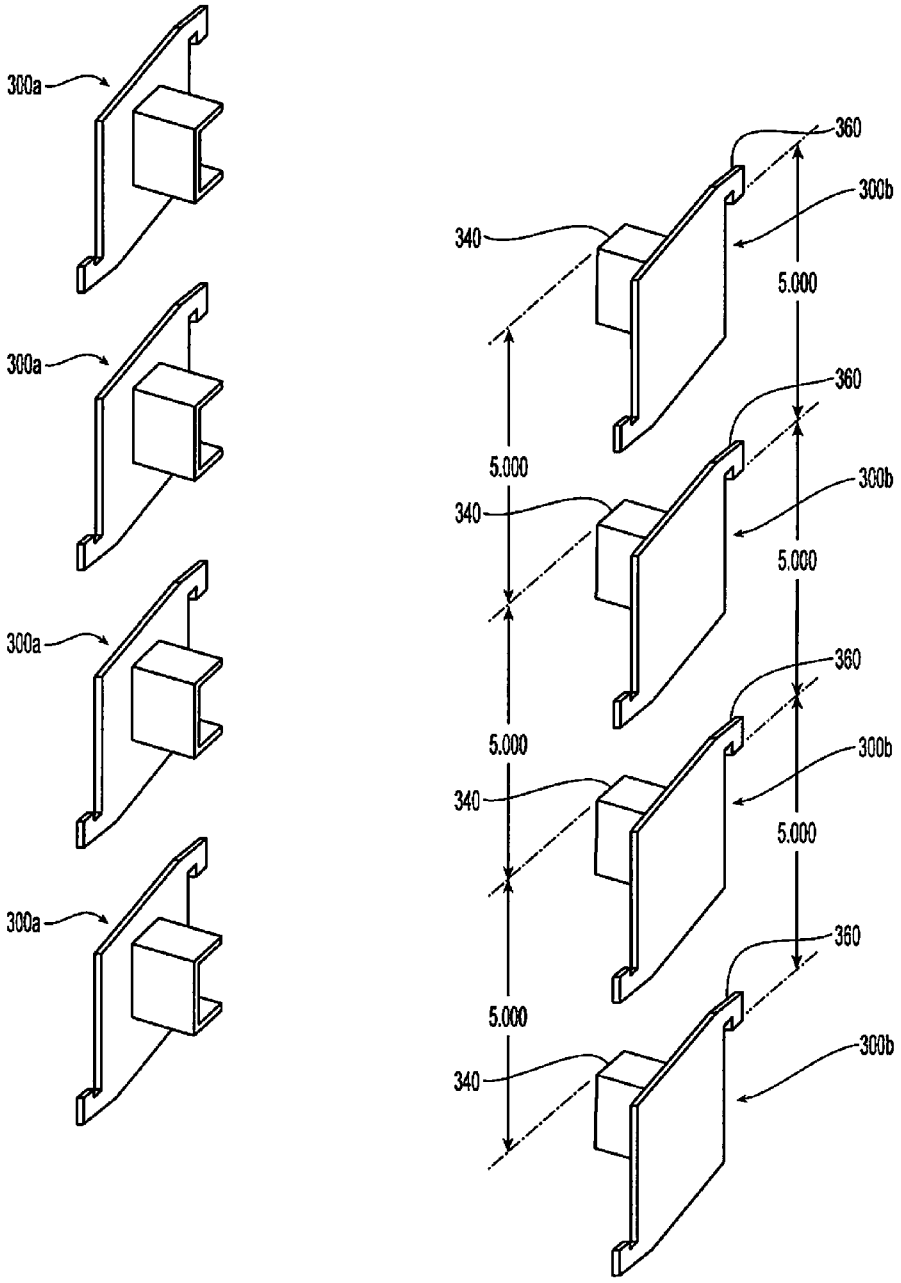
FIG. 10 is a perspective view of a plurality of the adjustable brackets of FIGS. 3-7 illustrated in a first orientation.
Figure 11:
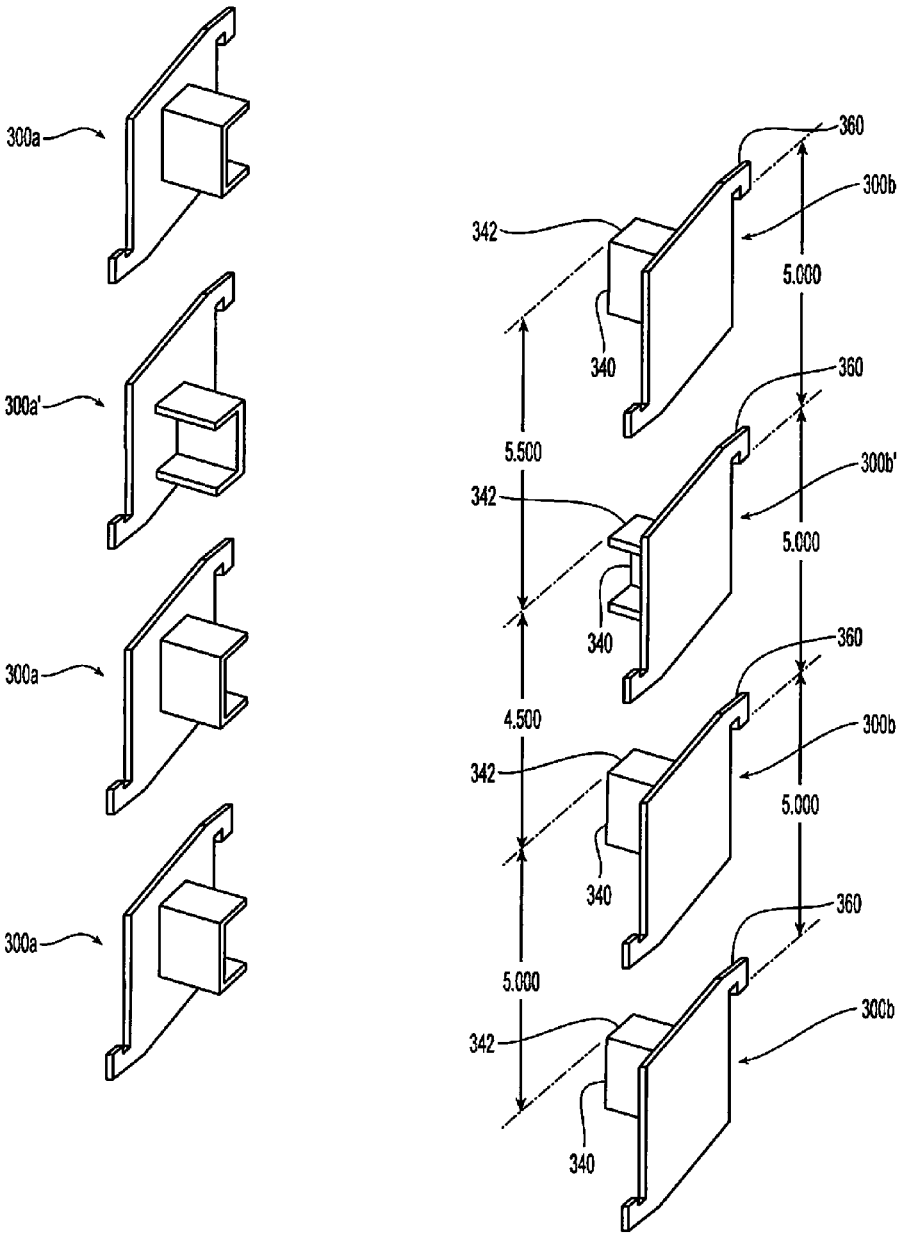
FIG. 11 is a perspective view of a plurality of the adjustable brackets of FIGS. 3-7 illustrated in a second orientation.

With reference to FIGS. 10 and 11, two orientations of the adjustable brackets 300*a*, 300*b* are illustrated. Both orientations are configured to engage the same support structure, since, for example, the distance between each vertically adjacent nub 360 is the same in each orientation (i.e., shown as "5.000").

In FIG. 10, the four illustrated left-side adjustable brackets 300*a* are orientated in the same direction as one another, and the four illustrated right-side adjustable brackets 300*b* are orientated in the same direction as one another. In this orientation, the distance between pairs of vertically adjacent C-channels 340, and thus horizontal bars 400 (see FIGS. 1 and 2), and corresponding shelves 200 (see FIGS. 1 and 2), is equal (i.e., shown as "5.000").

In FIG. 11, both left-side adjustable bracket second from the top 300*a*' and the right-side adjustable bracket second from the top 300*b*' are orientated in the opposite direction as compared to their respective vertically adjacent adjustable brackets 300*a*, 300*b*, respectively. In this orientation, while the distance between each vertically adjacent nub 360 is equal, the distance between pairs of vertically adjacent C-channels 340, and thus horizontal bars 400, and corresponding shelves 200, is different. That is, in the embodiment illustrated in FIG. 11, the distance between the top surface 342 of vertically adjacent C-channels 340 is shown as, from top to bottom: "5.500," "4.500" and "5.000." As can be appreciated, the orientation of the adjustable brackets 300*a*, 300*b* can be arranged to most-efficiently accommodate a variety of products "P" (i.e., either the same product displayed on all of the shelves (as shown), or at least one shelf displaying a different product from an adjacent shelf (horizontally- or vertically-adjacent)). Additionally, as can be appreciated with reference to FIGS. 3-7 and 10-11, the adjustable brackets 300*a*, 300*b* are configured to support a shelf 200 at the same angle when the adjustable brackets 300*a*, 300*b* are in the first orientation and when the adjustable brackets 300*a*, 300*b* are in the second orientation.

Figure 12:
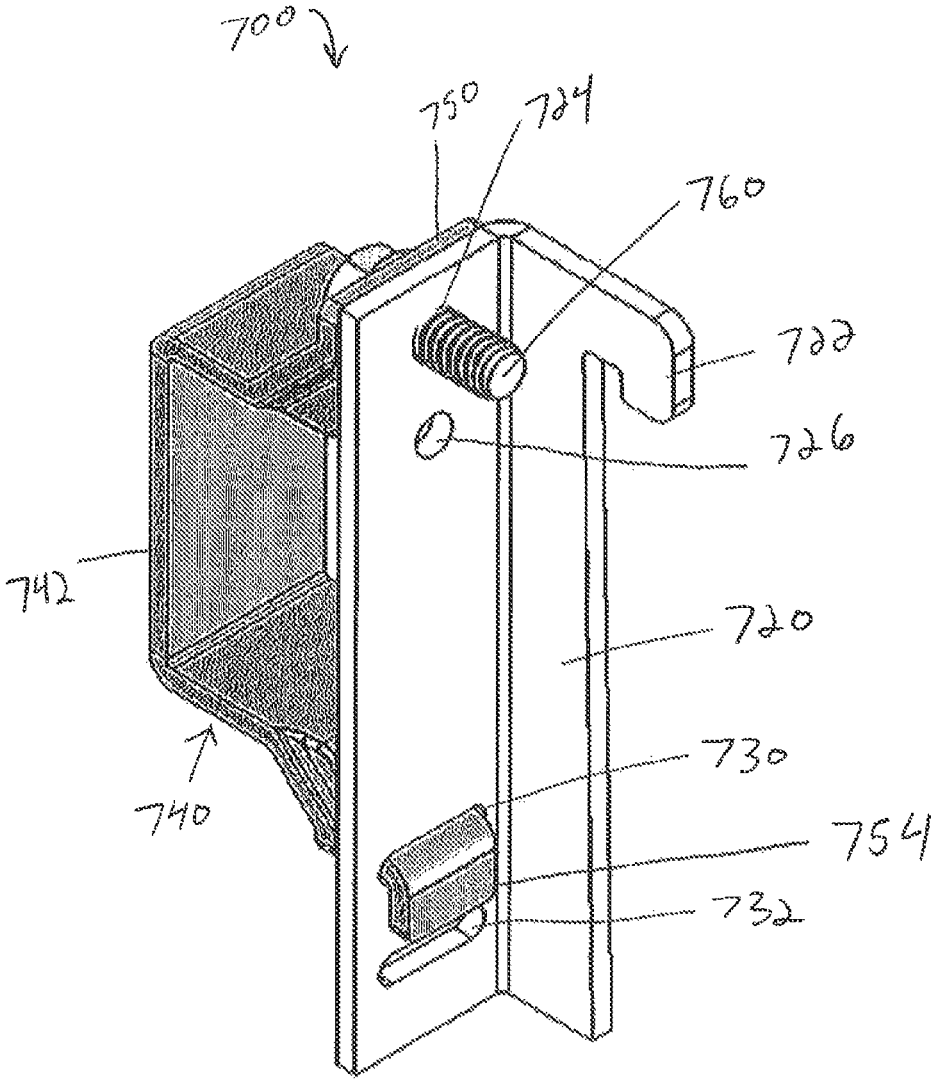
FIGS. 12 and 13 are perspective views of another embodiment of an adjustable bracket in accordance with an embodiment of the present disclosure.
Figure 13:
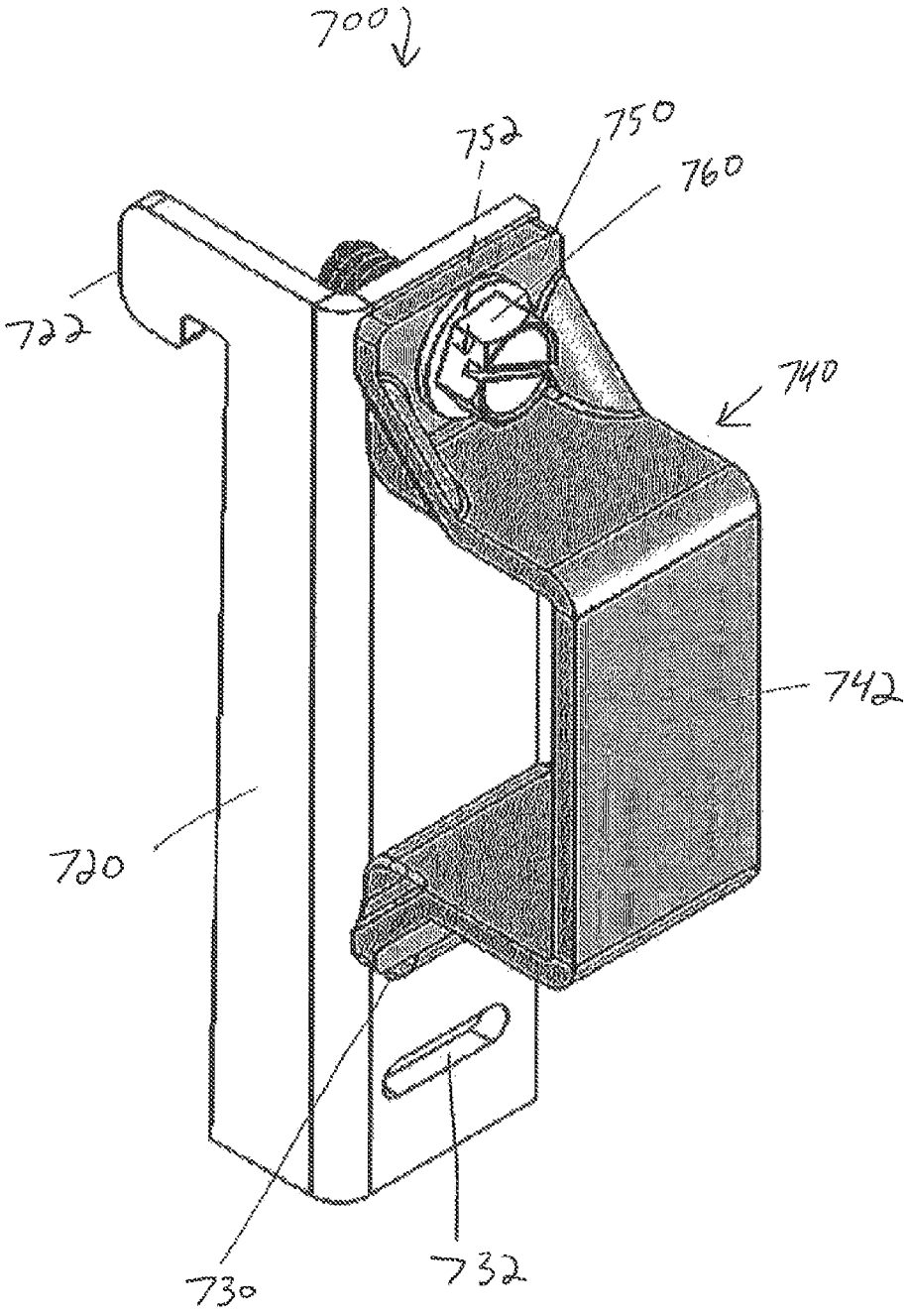

Referring now to FIGS. 12 and 13, another embodiment of an adjustable bracket 700 is shown. Adjustable bracket 700 includes a first support member 720, a second support member 740, and a connector (e.g., a screw) 760.

The first support member 720 includes a nub 722 which is configured to engage an aperture (or similar portion) of a supporting structure (e.g., a peg board or rack, not shown). The first support member 720 also includes a first hole 724 and a second hole 726 which are configured to engage the connector 760. Further, the first hole 724 and the second hole 726 may include a threaded portion to engage the connector 760, for example when the connector 760 is a screw, as shown. The first support member also includes a first slot 730 and a second slot 732 which are configured to engage a portion of the second support member 740, discussed below.

The second support member 740 includes a brace 742 (e.g., a C-channel) which is configured to support a portion of a shelf 200 or horizontal bar 400. The second support member 740 also includes a flange 750 including an aperture 752 (obscured from view by the connector 760) which is configured to accept a portion of the connector 760 therethrough. The second support member 740 also includes a tab 754 which is configured to engage the first slot 730 and the second slot 732, one at a time, of the first support member 720.

In use, to temporarily secure the first support member 720 and the second support member 740, the tab 754 of the second support member 740 is inserted through one of the first slot 730 (as shown) or the second slot 732 of the first support member 720. Insertion of the tab 754 through the first slot 730 causes the aperture 752 of the second support member 740 to be aligned with first hole 724 of the first support member 720. Next, the connector 760 is inserted through the aperture 752 and through the first hole 724 of the first support member 720. (As can be appreciated, insertion of the tab 754 through the second slot 732 causes the aperture 752 to be aligned with the second hole 726.)

To adjust the location (i.e., height) of the second support member 740 with respect to the first support member 720 (e.g., to change the adjustable bracket from a first configuration to a second configuration), a user removes the connector 760, removes the tab 754, reinserts the tab 754 into the other slot (e.g., the second slot 732), and reinserts the connector 760 through the aperture 752 and through the other hole (e.g., the second hole 726). As can be appreciated, a user can adjust the height of the second support member 740 with respect to the first support member 720 without removing the first support member 720 from the supporting structure. As can be appreciated, the angle of the supported shelf 200 or horizontal bar 400 is the same when the adjustable bracket is in its first orientation and in its second orientation.

In some circumstances, the distance between vertically adjacent members of the support structure is 1 inch. Here, it is envisioned that the vertical distance between the first hole 724 and the second hole 726 is about 0.5 inches. Likewise, it is envisioned that the vertical distance between the first slot 730 and the second slot 732 is about 0.5 inches. It is also envisioned that these distances can be any distance between about 0.25 inches and about 0.75 inches, or any other suitable distance. For example, if the distance between adjacent members of the support structure is 2 inches, for example, the distance between the first hole 724 and the second hole 726, and between the first slot 730 and the second slot 732 could be configured to be about 1.0 inches, or any distance between 0.25 inches and about 1.75 inches. Furthermore, it is envisioned that the first support structure 720 includes more than two holes 724, 726 and more than two slots 730, 732 that are disposed at different heights from each other. Such a first support structure 720 can be used with the illustrated second support structure 740.

Additionally, the illustrated adjustable bracket 700 is configured to support the left side of a shelf 200 or horizontal bar 400, or a left-side adjustable bracket. The present disclosure also includes a right-side adjustable bracket, which is a mirror image of the illustrated adjustable bracket 700, and which is configured to support a right side of a shelf 200 or horizontal bar 400. It is also envisioned that the left-side adjustable bracket 700 can support the right side of a shelf 200 or horizontal bar 400, and vice versa.

The present disclosure also relates to a method of displaying products using the product display system 100, including the adjustable brackets 300*a*, 300*b*, described herein.

While a particular embodiment of the disclosure is shown in the figures, it is not intended that the disclosure be limited thereto, as it is intended that the disclosure be as broad in scope as the art will allow and that the specification be read likewise. For example, while certain sizes (e.g., sizes of and between the adjustable brackets 300*a*, 300*b* and portions thereof) and shapes (e.g., shapes of the adjustable brackets 300*a*, 300*b*) are illustrated, the present disclosure shall not be limited to the illustrated sizes or shapes. Additionally, while the product display system 100 is shown and described including adjustable brackets 300*a*, 300*b*, it is envisioned and within the scope of the present disclosure that other types of brackets are usable therewith. Therefore, the above description should not be construed as limiting, but merely as exemplifications of various embodiments. Those skilled in the art will envision other modifications within the scope and spirit of the claims appended hereto.

The invention claimed is:

1. A product display system, comprising:

a plurality of brackets, each bracket including:

a first support member configured to mechanically engage a support structure and having at least two slots vertically offset from one another by a first distance; and a second support member having a tab insertable through the at least two slots of the first support member to releasably secure the second support member in at least two different locations of the first support member; and a plurality of shelves configured to support a plurality of products therein, each shelf of the plurality of shelves being configured to be mechanically engaged with the second support member of at least one bracket of the plurality of brackets;

wherein at least one bracket of the plurality of brackets is an adjustable bracket, the adjustable bracket being configurable in a first orientation or a second orientation, wherein in the first orientation the adjustable bracket supports an associated shelf of the plurality of shelves at a first height and in the second orientation the adjustable bracket supports the associated shelf at a second height, the first height being different from the second height.

2. The product display system of claim 1, wherein the adjustable bracket is configured to support the associated shelf at a first angle when the adjustable bracket is in its first orientation, and wherein the adjustable bracket is configured to support the associated shelf at the first angle when the adjustable bracket is in its second orientation.

3. The product display system of claim 1, wherein the plurality of brackets include a right-side bracket and a left-side bracket, the right-side bracket being different from the left-side bracket, and the right-side bracket being a mirror image of the left-side bracket.

4. The product display system of claim 1, wherein the first support member includes a nub for engaging a portion of the support structure.

5. The product display system of claim 1, wherein the first support member includes at least two holes, the at least two holes being vertically offset from one another by the first distance.

6. The product display system of claim 5, further including a connector, and wherein the second support member includes an aperture, the connector being insertable through the aperture of the second support member and through the at least two holes of the first support member.

7. The product display system of claim 1, wherein the at least two different locations are vertically offset from one another.

8. The product display system of claim 1, further including a connector configured to help releasably secure the first support member and the second support member.

9. The product display system of claim 1, wherein the adjustable bracket is configured to support the associated shelf at a first angle when the second support member is releasably secured to the first support member in a first location of the at least two different locations, and wherein the adjustable bracket is configured to support the associated shelf at the first angle when the second support member is releasably secured to the first support member in a second location of the at least two different locations.

10. A product display system, comprising:

a plurality of brackets, each bracket being configured to mechanically engage a support structure and including:

a connector;

a first support member having at least two holes vertically offset from one another by a first distance, and at least two slots vertically offset from one another by the first distance;

a second support member releasably securable to the first support member in at least two different locations, the second support member having an aperture, and a tab insertable through the at least two slots of the first support member, the connector being insertable through the aperture of the second support member and through the at least two holes of the first support member; and a plurality of shelves configured to support a plurality of products therein, each shelf of the plurality of shelves being mechanically engaged with at least one bracket of the plurality of brackets;

wherein at least one bracket of the plurality of brackets is an adjustable bracket, the adjustable bracket being configurable in a first orientation or a second orientation, wherein in the first orientation the adjustable bracket supports an associated shelf of the plurality of shelves at a first height and in the second orientation the adjustable bracket supports the associated shelf at a second height, the first height being different from the second height.

* * * * *